US009346095B2

(12) United States Patent
Knoche et al.

(10) Patent No.: US 9,346,095 B2
(45) Date of Patent: May 24, 2016

(54) DIE CUSHION DRIVE AND METHOD FOR OPERATING A DIE CUSHION DRIVE

(71) Applicant: Siemens Aktiengesellschaft, München (DE)

(72) Inventors: Frank Knoche, Rösrath (DE); Johannes Kurz, Amberg (DE); Oleg Schlegel, Erlangen (DE); Stephan Schäufele, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 285 days.

(21) Appl. No.: 14/039,698

(22) Filed: Sep. 27, 2013

(65) Prior Publication Data

US 2014/0090441 A1 Apr. 3, 2014

(30) Foreign Application Priority Data

Sep. 28, 2012 (EP) ..... 12186610

(51) Int. Cl.
*B21D 22/00* (2006.01)
*B21D 24/02* (2006.01)
*B21D 24/14* (2006.01)

(52) U.S. Cl.
CPC ..... *B21D 24/02* (2013.01); *B21D 24/14* (2013.01)

(58) Field of Classification Search
CPC ..... B21D 24/02; B21D 24/14
USPC ..... 72/453.13
See application file for complete search history.

(56) References Cited

U.S. PATENT DOCUMENTS

| | | | | |
|---|---|---|---|---|
| 6,205,780 | B1 | 3/2001 | Zervas | |
| 6,804,983 | B2 * | 10/2004 | Mori | B21D 24/02 72/350 |
| 8,757,056 | B2 * | 6/2014 | Kohno | B21D 24/14 100/269.01 |
| 2007/0240479 | A1 | 10/2007 | Nagai et al. | |
| 2009/0071218 | A1 | 3/2009 | Kohno et al. | |
| 2009/0158810 | A1 * | 6/2009 | Kohno | B21D 24/02 72/453.13 |

FOREIGN PATENT DOCUMENTS

| | | | |
|---|---|---|---|
| DE | 196 00 650 | C2 | 5/2003 |
| EP | 0 417 752 | A2 | 3/1991 |
| EP | 1 138 406 | A2 | 10/2001 |
| EP | 1 844 871 | A2 | 10/2007 |
| EP | 1 882 534 | A1 | 1/2008 |
| WO | 2010058710 | * | 5/2010 |

* cited by examiner

*Primary Examiner* — David B Jones
(74) *Attorney, Agent, or Firm* — Henry M. Feiereisen LLC

(57) ABSTRACT

A die cushion drive includes a first pump, operated by a first electrical machine and at least one hydraulic cylinder having first and second chambers, with the first chamber in fluid communication with the first pump. A die cushion mechanically connected to the hydraulic cylinder. During a controlled movement of the die cushion, a pressure regulation and a preliminary control are active, with a second pump being coupled to a second electrical machine. During preliminary control, the second electrical machine is operated as a generator, with a first valve being used as an adjustment element of the pressure regulation.

12 Claims, 7 Drawing Sheets

DIE CUSHION DRIVE AND METHOD FOR OPERATING A DIE CUSHION DRIVE

CROSS-REFERENCES TO RELATED APPLICATIONS

This application claims the priority of European Patent Application, Serial No. 12186610.7, filed Sep. 28, 2012, pursuant to 35 U.S.C. 119(a)-(d), the disclosure of which is incorporated herein by reference in its entirety as if fully set forth herein.

BACKGROUND OF THE INVENTION

The present invention relates to a die cushion drive.

The following discussion of related art is provided to assist the reader in understanding the advantages of the invention, and is not to be construed as an admission that this related art is prior art to this invention.

A movable die cushion can be provided in a hydraulic press. The movement of the die cushion is obtained by using a die cushion drive. In hydraulic presses the pressure in the hydraulic medium is generated by a pump able to be driven by an electric motor.

It would be desirable and advantageous to provide an improved die cushion drive to obviate prior art shortcomings.

SUMMARY OF THE INVENTION

According to one aspect of the present invention, a die cushion drive includes a first pump, a first electrical machine for operating the first pump, at least one hydraulic cylinder having first and second chambers, with the first chamber in fluid communication with the first pump, and a die cushion mechanically connected to the hydraulic cylinder.

With a hydraulic die cushion a defined regulated opposing force is applied in the reforming area. This is done for example by a plurality of hydraulic cylinders. The term "plurality" is hereby to be understood as relating to at least two. Hydraulic fluid (especially oil) expelled by the movement of a hydraulic cylinder in a chamber of the cylinder is let out into a tank for example.

From a process technology standpoint, a high accuracy is demanded in the checking of the force exerted by the die cushion or the checking of the movement exerted by the die cushion. This means that sensors and/or regulators and also adjusters especially have a sampling time of less than I ms in order to achieve a rapid reaction of the adjustment element. Examples of sensors include pressure sensor, speed sensor, position sensor, etc. Examples of adjustment elements include hydraulic valve (especially a proportional valve or a servo valve), a hydraulic pump (especially a servo pump), an electrical machine (especially a synchronous machine or an asynchronous machine).

When the pressure is only regulated via hydraulic pumps, rapid regulation times can only be achieved with difficulty, wherein in one embodiment of the die cushion drive hydraulic pressure reservoirs can be used for supplying system pressure, wherein these are charged using pump technology.

Advantageously, the die cushion drive can include hydraulic reservoirs and fast continuously-variable valves for hydraulic die cushions. In this case however energy is only successfully recovered with difficulty from a movement of the die cushion. In one embodiment however a pneumatic pressure reservoir is filled via a receding hydraulic cylinder, with which an upwards movement of the die cushion is then realized. Where an electrically-driven die cushion is used, energy recovery through generator mode operation of an electric motor used there is possible.

In a further embodiment of the die cushion drive, a pump can be used on each piston side of the hydraulic cylinder, which is able to be driven by electrical machines, wherein the electrical machines are able to be operated in generator mode for recovery of energy. Generator mode operation is then advantageously possible for each direction of movement of the hydraulic cylinder.

A die cushion drive according to the present invention has a first pump, a first electrical machine to drive the first pump and a hydraulic cylinder or a plurality of hydraulic cylinders. The hydraulic cylinder or cylinders each have a first chamber and a second chamber for hydraulic fluid, wherein the first pump is used for supplying the first chamber or the first chambers of the hydraulic cylinders, wherein the hydraulic cylinder or the hydraulic cylinders are mechanically linked to a die cushion. In order to make energy recovery possible, the electrical machine is able to be operated as a generator. When hydraulic fluid is compressed by the pump, the pump serves as a drive for the electrical machine which generates electrical energy in generator mode and feeds it back into a power network and/or into a capacitor and/or into an intermediate circuit of a drive network.

In one embodiment of the die cushion drive, a pump (especially a servo pump) supplies a plurality of first chambers (especially upper chambers of the respective hydraulic cylinder) jointly. This reduces the number of electrical and also mechanical components if a pump driven via an electrical machine is not to be provided for each first chamber of a plurality of hydraulic cylinders.

In an embodiment of the die cushion drive, a pressure sensor can be made available for measuring the hydraulic pressure in a first pressure line between the first pump and the hydraulic cylinder or the plurality of hydraulic cylinders. The pressure sensor serves as an aid in order to set a pressure at the first chamber of one of the hydraulic cylinders by means of the first pump. The sensor measures an actual value which can be used for pressure regulation or a pressure control.

The hydraulic cylinder or the hydraulic cylinders, as well as the first chamber, each also have a second chamber, wherein the second chamber is especially a lower chamber. A plurality of hydraulic cylinders is present for each die cushion, wherein in one embodiment separate pressure sensors are provided for the second chambers. In particular at least one pressure sensor in each case and/or a continuously-variable hydraulic valve and/or a servo pump is present for a plurality of hydraulic cylinders in relation to the second chambers of these cylinders. The servo pumps can each be mechanically coupled to an electrical machine which can be operated both as a motor and also as a generator. The pressure sensors can also be attached to pressure lines which are directly connected to the respective second chamber of the cylinder, in order to measure the pressure in the second chamber.

In an embodiment of the die cushion drive, a first hydraulic cylinder from the plurality of hydraulic cylinders can be connected with its second chamber via a second pressure line to a second pump, wherein a second hydraulic cylinder of the plurality of hydraulic cylinders can be connected with its second chamber via a third pressure line to a third pump. In this way the respective first chamber of the hydraulic cylinder is only able to be supplied via one pump and the respective second chambers of the cylinder can be supplied or emptied separately from one another by different pumps separated from one another. This makes flexible regulation of different hydraulic cylinders possible.

In one embodiment of the die cushion drive, the second pressure line can be connected to a first valve and the third pressure line can be connected to the second valve, wherein a first pressure sensor is especially present for measuring the pressure in the second pressure line and a second pressure sensor is present for measuring the pressure in the third pressure line. Via the valves it is possible, as well as the pumps connected to the second chambers of the hydraulic cylinders, to let hydraulic fluid out of the respective second chambers. The valves can be a proportional valve or servo valve. The valves, like the electrical machines for operating the pumps (especially the servo pumps), represent adjustment elements of a regulation of the die cushion drive.

In one embodiment of the die cushion drive, the valve can be used as adjustment element for a preliminary control, when hydraulic fluid is let out of the second chamber of the respective cylinder. The pumps assigned to the second chambers can be used as an adjustment element for a pressure regulation.

To now be able to exercise better control or to be able to operate the die cushion drive in a more energy-efficient manner, the valve can be used as an adjustment element for pressure regulation and the respective electrically-driven pump, which is assigned to the second chamber of the respective cylinder, can be used as an adjustment element for preliminary control. The valves exhibit a rapid response behavior and are thus very well suited as an adjustment element for rapid regulation. Decoupling of electrical machine and pumps means that this adjustment element has a lower rigidity in relation to the regulation so that it is advantageous not to use this for the pressure regulation but as an adjustment element for the preliminary pressure control. This can additionally have the advantage of enabling energy to be fed back into the power network through the generator mode operation of the electrical machine. Since a smaller volume flow of hydraulic fluid is also necessary as adjustment variable for the regulation by the valve, when this is compared to a valve which serves as an adjustment element for a pressure regulator, the result is that comparatively more hydraulic fluid can be conveyed through the pump which is directly coupled to the second chamber in an expulsion phase.

In one embodiment of the die cushion drive, the first electric machine is able to be regulated by drive regulator, wherein the second electrical machine is able to be regulated a second drive regulator, wherein the third electrical machine is able to be regulated by a third drive regulator, wherein a data bus connects the drive regulators to each other for data transmission. Advantageously the pressure regulation of the die cushion with the valve as adjustment variable is also integrated in this case into a regulation device which also has the drive regulator or a plurality of drive regulators. The integration of the regulators enables the signal delay times to be improved and a faster, improved regulation of the die cushion is created.

According to another aspect of the present invention, a method for operating a die cushion drive having a first pump, a first electrical machine for operating the first pump, at least one hydraulic cylinder having first and second chambers, with the first chamber in fluid communication with the first pump, and a die cushion mechanically connected to the hydraulic cylinder, includes activating a pressure regulation and a preliminary control during a controlled movement of the die cushion, operating a second pump to provide a preliminary control of the die cushion, coupling the second pump to a second electrical machine, operating the second electrical machine during the preliminary control as a generator, and operating a first valve as an adjustment element of the pressure regulation.

In a method for operating a die cushion drive a pressure regulation and a preliminary control are active during a controlled movement of the die cushion. A pump is used for preliminary control, which is also referred to below in relation to the subsequent description of the figures as the second pump. The second pump is coupled to a second electrical machine. The electrical machine thus drives the pump or is driven by the latter especially in generator mode. Advantageously, the electrical machine can be driven as a generator during a period in which preliminary control is active. This period is especially a period in which the plunger of the press exerts a force on the die cushion and plunger and also die cushion move in the same direction. The first valve will be used as a control element of the pressure regulation. The valve is for example a proportional valve or servo valve. The energy efficiency of the press can be increased by the generator mode operation of the electrical machine of the pump which is associated with the pressure line of the valve.

In one embodiment of the method for operating a die cushion drive, a die cushion drive can be used which features one of the embodiments already described. Further embodiments of the die cushion drive are also described in the subsequent description of the figures In an embodiment of the method, when the plunger of the press strikes the die cushion, a switchover is made to pressure regulation. The switchover is undertaken for example from a position regulation or speed regulation to the position regulation. For the regulation of position, speed or pressure regulator types known from regulation technology can be used.

In an embodiment of the method, the die cushion can be pre-accelerated before the plunger strikes the die cushion. This makes possible a reduction of disruptive variables for the regulation of the die cushion when plunger and die cushion strike one another.

In one embodiment of the method, a preliminary control of the die cushion can be carried out so that the preliminary control is undertaken by the second pump or especially also by a third pump or further pump as a control element for this preliminary control. The second, third or further pumps are connected to chambers of hydraulic cylinders such that, during a press actuation, hydraulic fluid is expelled from these chambers (expulsion phase).

In one embodiment of the method, these chambers can also each be connected to one valve. In a variation of the method, the valves can be closed when the second and the third pump are used as drives for the respective electrical machine operated as a generator. In a further variation, these valves can be active as control element (open or closed) and serve to regulate the pressure of the die cushion. In one embodiment of the method, strain relief can be performed at the end of the press range. This additionally improves the system behavior.

In an embodiment of the method for operating a die cushion, drive pressure regulation and preliminary control can both be active in an expulsion phase, wherein especially an evaluation factor (gain) for the preliminary control is able to be changed. This evaluation factor can be changed before the regulation and/or during the regulation (reduced or increased). This enables the influence that the preliminary control has on the behavior of the die cushion to be adjusted.

In one embodiment of the method for operating a die cushion drive, the first pump can be inactive in the expulsion phase. The first pump is the pump which supplies a plurality of chambers of the same type of different hydraulic cylinders with hydraulic fluid. The first pump is advantageously connected with the second or third or further pump such that hydraulic fluid is able to be exchanged. Thus for example hydraulic fluid can be pushed from the valves or the second or third or further pump through the passive first pump. Thus in this passive operating state of the first pump this can serve as a drive for the first electrical machine connected to it, which is also able to be operated as a generator, and can thus feed back electrical energy.

In one embodiment of the method for operating a die cushion drive, the first pump can be activated in a phase of an upward movement of the die cushion. Both the first pump and also all further pumps can advantageously be operated in four quadrants. This applies accordingly to the electrical machines which are coupled to the pumps.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
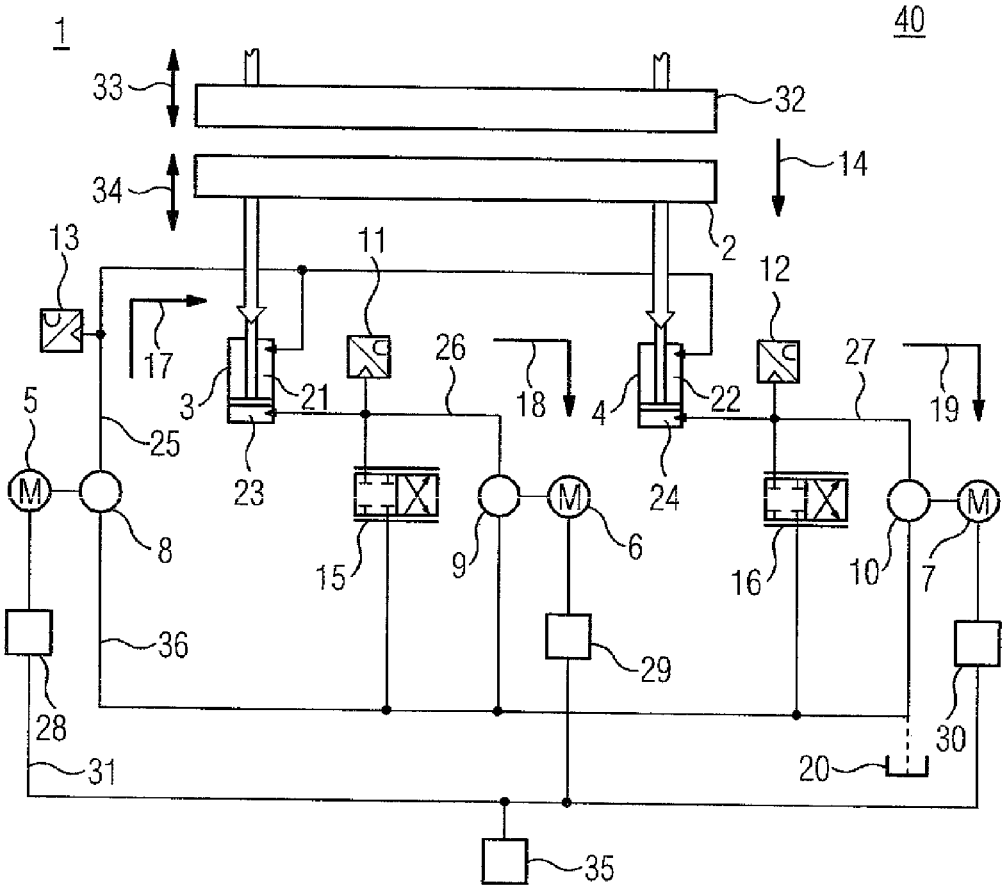
FIG. 1 shows a first phase of a press process of a press with a die cushion.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

A sequence of a press process of a press with die cushion can for example be subdivided into the following steps (phases):

1. An upwards movement of the piston and if necessary a pre-acceleration of the die cushion before the point of contact;
2. An expulsion phase: When the plunger strikes the die cushion a switchover is made into pressure regulation and strain is relieved if necessary at the end of the drawing range.
3. An upwards movement of the plunger and raising the die cushion into an initial position.

For better understanding of the present invention, reference is made to exemplary embodiments shown in FIGS. 1 to 3 below. In this case FIG. 1 is used to describe the first step, FIG. 2 to describe the second step and FIG. 3 to describe the third step. The same reference characters are used in the description of the figures for elements of the same type.

The diagram depicted in FIG. 1 shows schematically a section of a press 40 with a plunger 32 and a die cushion 2. The potential directions of movement 33 of the plunger 32 and the potential directions of movement 34 of the die cushion 2 are shown by arrows. A die cushion drive 1 is provided for the movement of the die cushion 2. This die cushion drive 1 includes the die cushion 2 and first and second hydraulic cylinders 3, 4 connected to the die cushion 2. A die cushion can also be moved by a number of hydraulic cylinders of between one and greater than two, which however is not shown in FIGS. 1 to 3. The first hydraulic cylinder 3 has a first chamber 21 (upper chamber) and a second chamber 23 (lower chamber). The second hydraulic cylinder 4 also has a first chamber 22 (upper chamber) and a second chamber 24 (lower chamber). The first chambers 21, 22 of the hydraulic cylinders 3, 4 are supplied or emptied via a first pressure line by a first pump 8. The second chamber 23 of the hydraulic cylinder 3 is supplied or emptied via a second pressure line 26 by a second pump 9. The second chamber 24 of the hydraulic cylinder 4 is supplied or emptied via a third pressure line 27 by a third pump 10. The first pump 8 is coupled to a first electrical machine 5. The second pump 9 is coupled to a second electrical machine 9. The third pump 10 is coupled to a third electrical machine 7. The electrical machines 5, 6 and 7 can be operated in motor or generator mode, wherein drive regulators 28, 29 and 30 are provided for regulating the electrical machines 5, 6, 7. Although not every part of a drive is shown, for example the current rectifier itself is not shown, it can be seen that a first drive regulator 28 regulates the first electrical machine 5, that a second drive regulator 29 regulates the second electrical machine and that a third drive regulator 30 regulates the third electrical machine. The drive regulators 28, 29 and 30 are connected to each other via a data bus 31 for data transmission. Also connected to the data bus is a superordinate die cushion regulator 35. Valves 15 or 16 can also be activated for example using the superordinate die cushion regulator 35. In an embodiment of the die cushion drive 1, different regulators can also be integrated into a regulation device, but this is not shown in the figures however. The valves 15, 16 can be subdivided into a first valve 15 and a second valve 16. The first valve 15 is connected to the second pressure line. The second valve 16 is connected to the third pressure line 27. The first, second and third pumps 8, 9 and 10 and also the first and second valves 15, 16 are connected to each other via a collecting line 36. The collecting line 36 is able to be emptied into a tank 20 or can accept hydraulic fluid from the tank. To measure the hydraulic pressures, a first pressure sensor 11 is present for the second pressure line 26, a second pressure sensor 12 is present for the third pressure line 27 and a third pressure sensor 13 is present for the first pressure line. The pressure sensors 11, 12, 13 detect actual pressure values, especially for pressure regulation. The data transmission connection between the pressure sensors 11, 12, 13 and the pressure regulator is not shown in the figures for sake of clarity.

Figure 2:
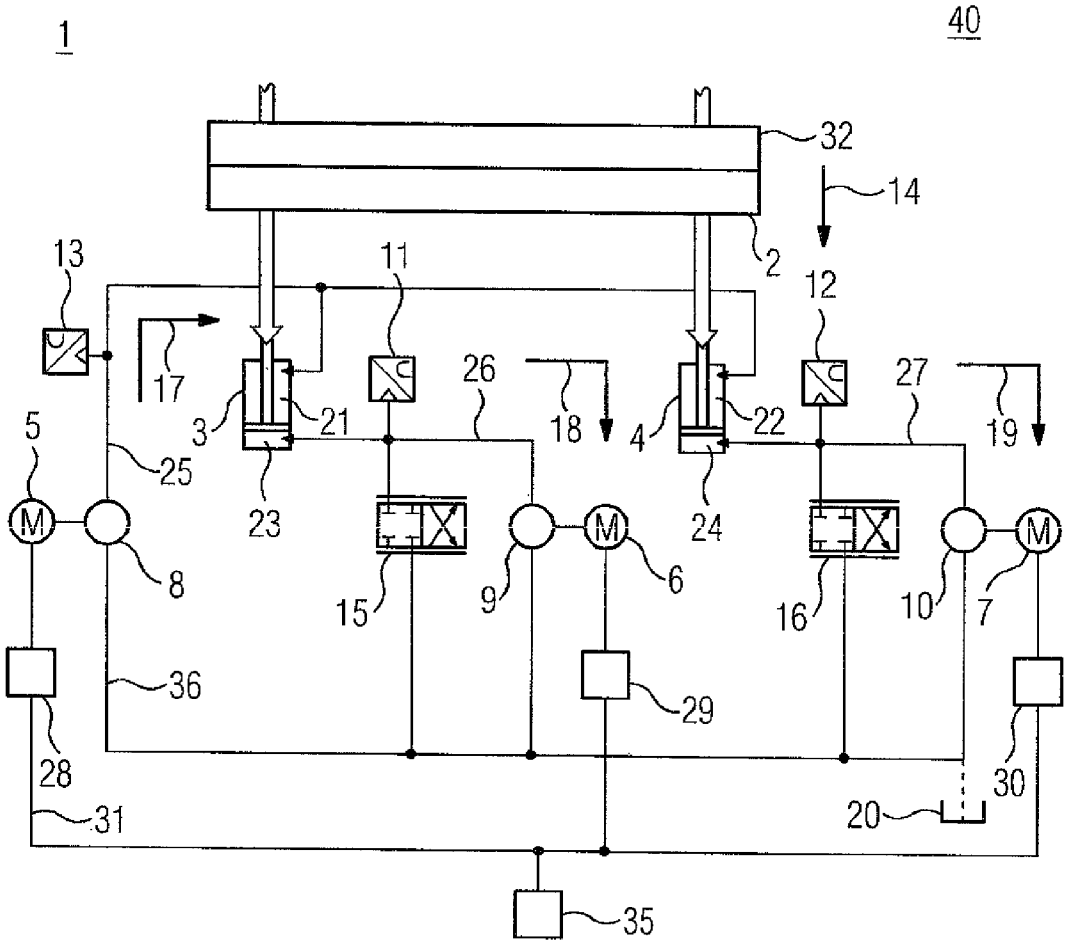
FIG. 2 shows a second phase of a press process of a press with a die cushion.
Figure 3:
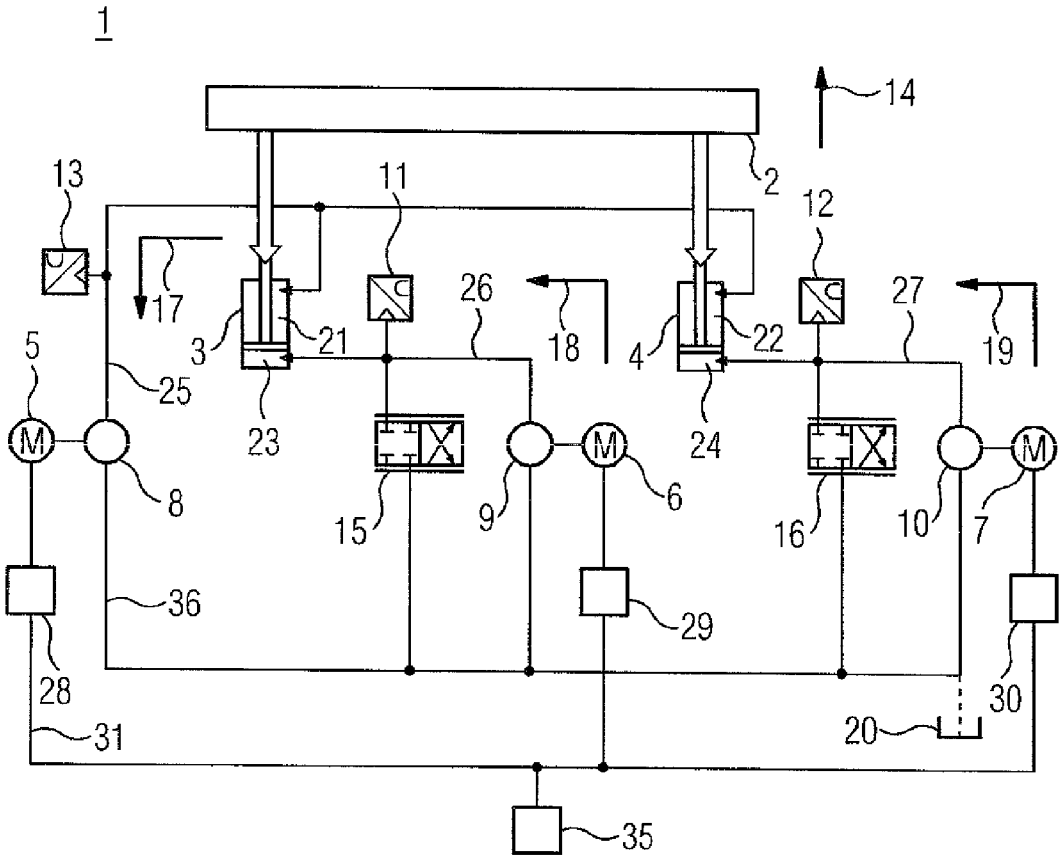
FIG. 3 shows a third phase of a press process of a press with a die cushion.

In FIGS. 1 to 3, directions of movement 14 of the die cushion 2 and flow directions 17 18, 19 of the hydraulic fluid are depicted by arrows.

FIG. 1 is intended to show a first phase of a press process, wherein further phases not shown can also precede the first phase. In an embodiment of the die cushion drive 1, in the first phase (upwards movement) a common servo pump 8 (first pump) can provide the oil supply (oil is a hydraulic fluid) of all die cushion cylinders (first hydraulic cylinder 3 and second hydraulic cylinder 4), wherein a preliminary control for the die cushion cylinders 3, 4 is controlled via individual pumps (second pump 9 and third pump 10) for each cylinder 3, 4. In this case, the first and second valves 15, 16, which especially are needed in the second phase as hydraulic valves, are advantageously closed in this first phase. In the second phase (expulsion phase), which is described in greater detail with reference to FIG. 2, when the plunger 32 strikes the die cushion 2 (a part to be pressed, not shown in the figures, is located between piston and die cushion), the pressure regulation is started via the hydraulic valves 15, 16 and on the other hand the movement of the die cushion is subjected to preliminary control via the servo pumps 9, 10, respectively.

The diagram in accordance with FIG. 2, like FIG. 1, shows a die cushion drive 1, wherein the piston 32 rests on the die cushion 2. A material to be pressed lying between them is not shown. FIG. 2 shows phase two in which there is a switchover to the pressure regulation of the die cushion 2. When the second pump 9 and the third pump 10 are now used as adjustment elements for a preliminary control and when the first valve 15 and the second valve 16 are used as adjustment elements for a pressure regulation, this combination produces an advantageously fast regulation via valves and additionally the feedback capability of pumps with especially servomotors (second electrical machine 6 and third electrical machine 7). Advantageously, the pressure regulation can also be used in addition to the preliminary control via the servo pumps 9, 10. A common servo pump 8 (first pump) can also be switched off or a common system pressure can be built up with said pump.

In the diagram in accordance with FIG. 3, a third phase and upwards movement of the die cushion 2 is shown, wherein the piston is no longer shown in FIG. 3. The upwards movement is indicated by arrow 14. The upwards movement is controlled or regulated via the respective servo pump (second and third pumps 9, 10) of the die cushion cylinder(s) 3, 4. For better movement control an opposing pressure can be built up via the common system pressure pump (first pump 8). The flow directions 17, 18, 19 for the hydraulic fluid are reversed by comparison with steps 1 and 2, as is also shown in FIG. 3.

Through the combination of servo pump and hydraulic valve in the expulsion phase a rapid pressure regulation can be achieved via the valve and via the servo pump the main oil flow (this is the hydraulic fluid) can be fed back in generator mode. If valve and pump were both to control the pressure regulation in the expulsion phase, they might possibly operate against each other. In order to avoid this, the main oil flow is taken away via pump 2, 3 for example and generator-mode energy is fed back by the pressure. Fast reaction times can be achieved in the regulation by the valves 15, 16.

The Figures described below focus on the hydraulic concept of the die cushion drive.

Figure 4:
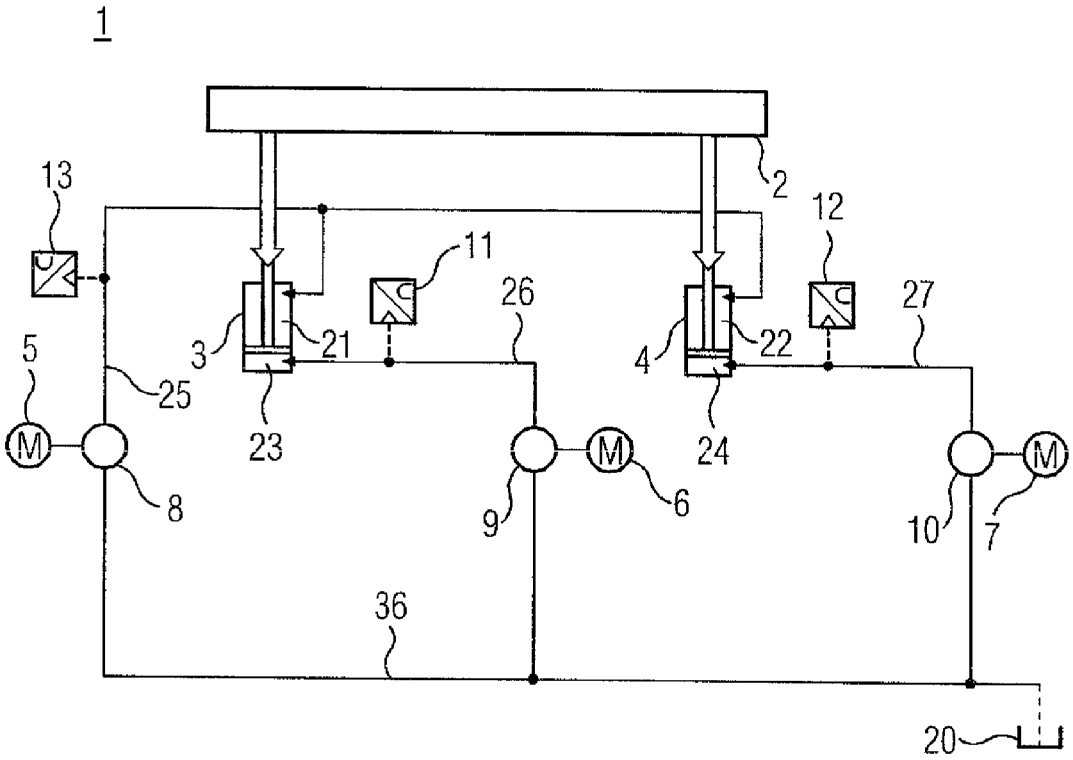
FIG. 4 shows a die cushion drive without control valves.

The diagram in accordance with FIG. 4 shows a variation of the die cushion drive 1, wherein in the variation shown, the die cushion drive 1, for the second chambers 23, 24 of the hydraulic cylinders 3, 4, only provides for the pumps 9, 10 and does not provide any valves such as those shown in FIGS. 1 to 3. This embodiment without control valves has the advantage of using fewer mechanical components that can fail. The use of the pumps 9, 10, which are able to be driven by the electrical machines 6, 7, further enables a pressure regulation and also a preliminary control to be carried out. The pumps 9, 10 serve as adjustment element for the preliminary control and for the pressure regulation. The electrical machines 6, 7 can continue to be operated in generator mode when the second chambers 23, 24 are reduced in size, wherein the pump 8 can advantageously be used in this case as adjustment element for the pressure regulation.

Figure 5:
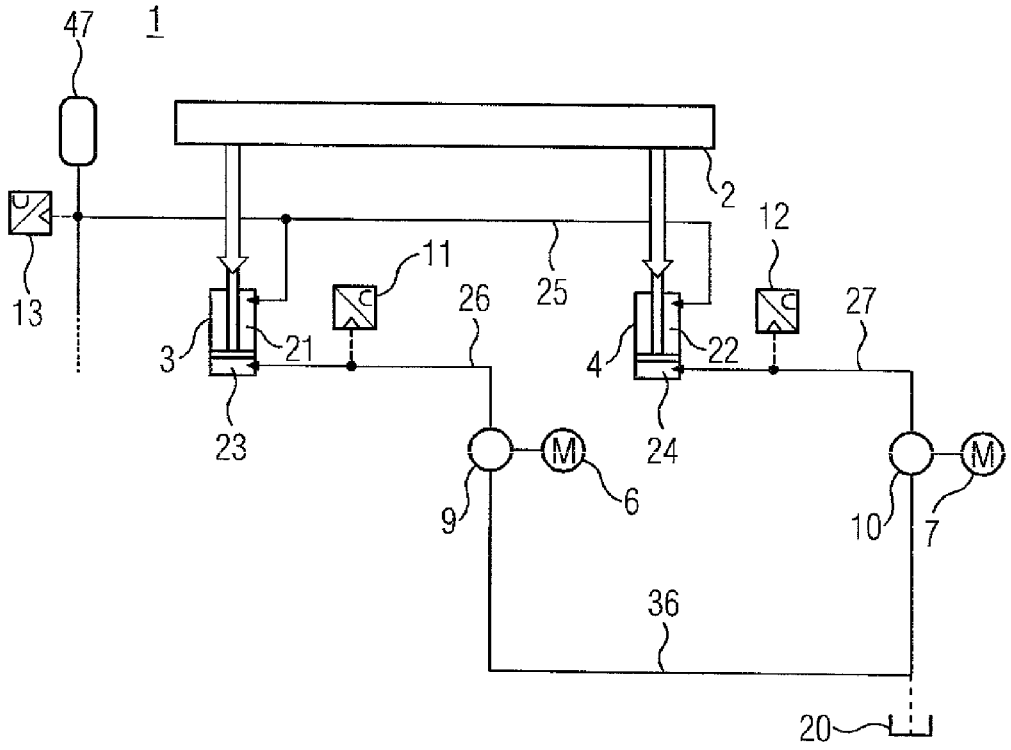
FIG. 5 shows a die cushion drive with a pressure tank.

The diagram depicted in FIG. 5 shows a die cushion drive 1, wherein the first chambers 21, 22 are supplied with hydraulic fluid via a pressure tank 47. The pressure tank 47 forms a type of accumulator pump. This distinguishes this version from that shown in FIG. 4. This also enables complex mechanics to be reduced, which improves the failsafe behavior.

Figure 6:
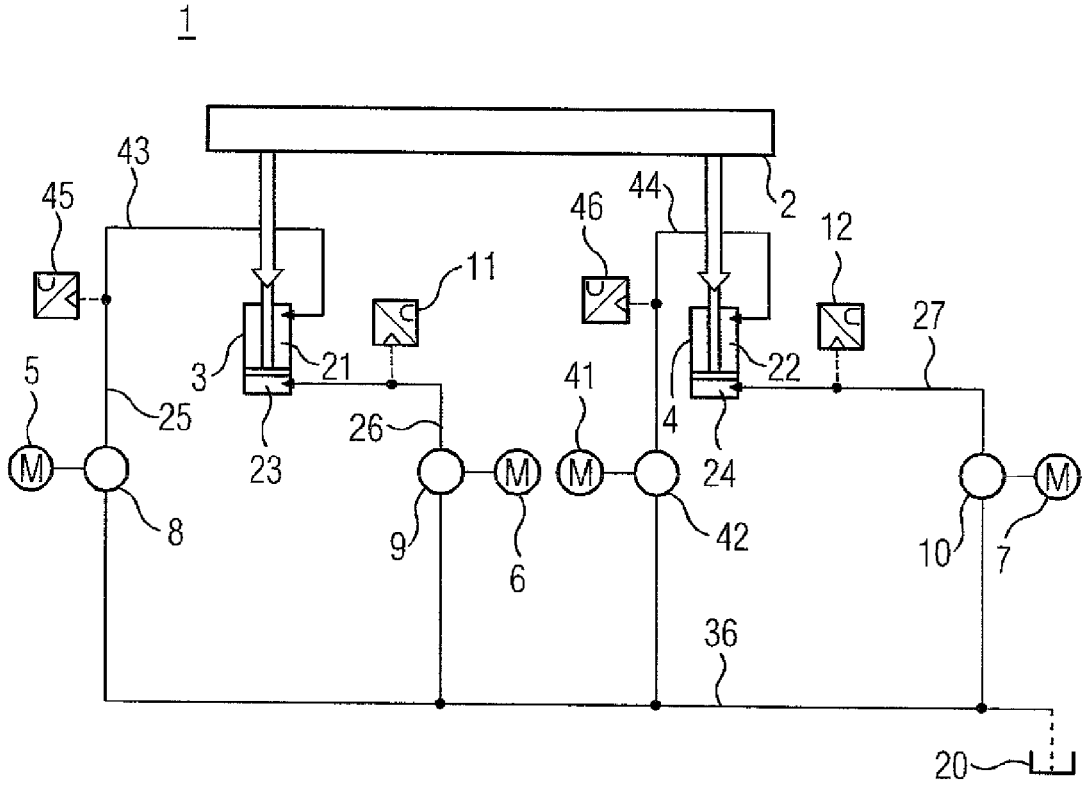
FIG. 6 shows a die cushion drive with two pumps per cylinder in each case.

The diagram depicted in FIG. 6 shows a die cushion drive 1 in which the first chambers 21, 22 of the hydraulic cylinders 3, 4 are operated by separate pumps 8 and 42. The first chamber 21 of the hydraulic cylinder 3 is connected via a fourth pressure line 43 to the first pump 8, wherein the pressure in the pressure line 43 is able to be measured via a fourth pressure sensor 45. The first chamber 22 of the hydraulic cylinder 4 is connected via a fifth pressure line 44 to the fourth pump 42, wherein the pressure in the pressure line 44 is able to be measured by a fifth pressure sensor 45. The use of four pumps, two for each cylinder, has the advantage that the hydraulic cylinders 3, 4 can be regulated independently of one another. Each hydraulic cylinder 3, 4 has an additional adjustment element for a pressure regulation and/or a preliminary control, which does not directly influence the behavior of other cylinders, as is the case in a jointly-used pump for the first chambers in accordance with FIG. 4. The pump 42 is connected to the electrical machine 41. Since two pumps are assigned to each cylinder and thus also two electrical machines, at least one of the electrical machines per cylinder can be operated as a generator when the other is operated as a motor. Both electrical machines can also be operated as motors, which may help to improve the regulation quality during pressure regulation.

Figure 7:
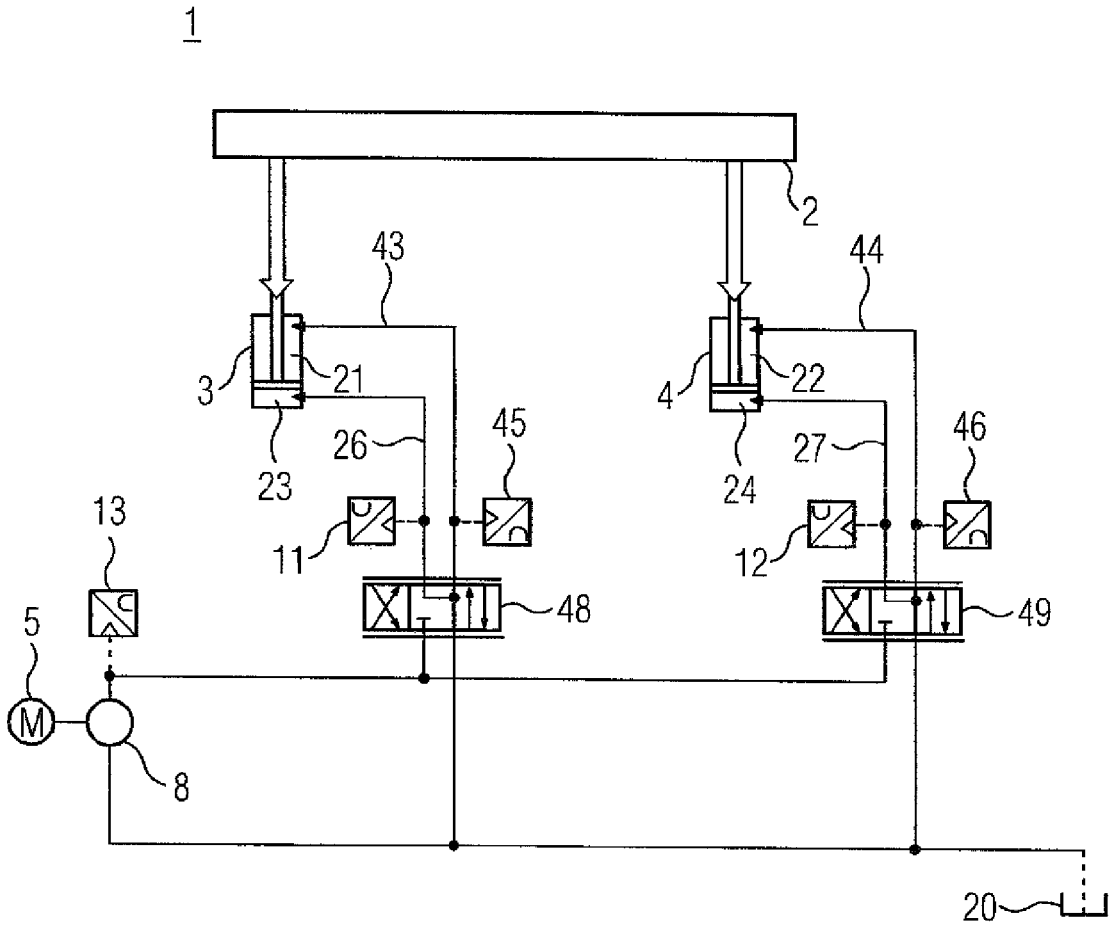
FIG. 7 shows a die cushion drive with only one common pump.

The diagram depicted in FIG. 7 shows a further variation of a die cushion drive 1. In the system shown the first pump 8 serves to establish a hydraulic pressure for the hydraulic system as a whole. The first hydraulic cylinder 3 is connected with its first and second chambers 21, 23 to a first ¾-way valve 48. The cylinder is connected via the second pressure line 26 and the fourth pressure line 43. The first pressure sensor 11 serves to measure the pressure in the second chamber 23. The fourth pressure sensor 45 serves to measure the pressure in the first chamber 21. The second hydraulic cylinder 4 is connected with its first and second chambers 22, 24 to a second ¾-way valve 49. The cylinder is connected via the third pressure line 27 and the fifth pressure line 44. The second pressure sensor 12 serves to measure the pressure in the second chamber 24. The fifth pressure sensor 46 serves to measure the pressure in the first chamber 22. There is still only one pump 8, which is coupled to the electrical machine 5, wherein the electrical machine 5 is able to be operated as a motor and also as a generator.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A die cushion drive, comprising:

a first pump;

a first electrical machine for operating the first pump;

at least one hydraulic cylinder having first and second chambers, with the first chamber in fluid communication with the first pump;

a die cushion mechanically connected to the hydraulic cylinder;

a second pump;

a second pressure line connecting the second chamber of the first hydraulic cylinder to the second pump;

a second hydraulic cylinder having first and second chambers;

a third pump; and a third pressure line connecting the second chamber of the second hydraulic cylinder with the third pump.

2. The die cushion drive of claim 1, further comprising a first pressure line extending between the first pump and the hydraulic cylinder, and a pressure sensor for measuring a hydraulic pressure in the first pressure line.

3. The die cushion drive of claim 1, further comprising a first valve operably connected to the second pressure line, a second valve operably connected to the third pressure line, a first pressure sensor measuring a pressure in the second pressure line, and a second pressure sensor measuring a pressure in the third pressure line.

4. The die cushion drive of claim 1, further comprising a first drive regulator configured for regulating the first electrical machine, a second electrical machine for operating the second pump, a second drive regulator configured for regulating the second electrical machine, a third pump, a third electrical machine for operating the third pump, a third drive regulator configured for regulating the third electrical machine, and a data bus connecting the first, second and third drive regulators for data transmission.

5. A method for operating a die cushion drive having a first pump, a first electrical machine for operating the first pump, at least one hydraulic cylinder having first and second chambers, with the first chamber in fluid communication with the first pump, and a die cushion mechanically connected to the hydraulic cylinder, said method comprising:

activating a pressure regulation and a preliminary control during a controlled movement of the die cushion;

operating a second pump to provide a preliminary control of the die cushion;

coupling the second pump to a second electrical machine;

operating the second electrical machine during the preliminary control as a generator; and operating a first valve as an adjustment element of the pressure regulation.

6. The method of claim 5, further comprising switching over to pressure regulation, when a plunger strikes the die cushion.

7. The method of claim 6, further comprising pre-accelerating the die cushion before the plunger strikes the die cushion.

8. The method of claim 5, wherein the preliminary control of the die cushion is performed, when the first valve is closed.

9. The method of claim 5, further comprising carrying out a strain relief at an end of press process.

10. The method of claim 5, wherein the pressure regulation and the preliminary control are activated in an expulsion phase, and further comprising changing an evaluation factor for the preliminary control.

11. The method of claim 10, wherein the first pump is inactive in the expulsion phase.

12. The method of claim 5, further comprising activating the first pump in a phase of an upwards movement of the die cushion.

* * * * *